US007172321B1

(12) United States Patent
Tseng

(10) Patent No.: US 7,172,321 B1
(45) Date of Patent: Feb. 6, 2007

(54) LAMPSHADE-FIXING SEAT STRUCTURE

(76) Inventor: Ming-Chi Tseng, No. 18, Jhensing E. St., Wufong Township, Taichung County (TW)

( * ) Notice: Subject to any disclaimer, the term of this patent is extended or adjusted under 35 U.S.C. 154(b) by 0 days.

(21) Appl. No.: 11/342,812

(22) Filed: Jan. 31, 2006

(51) Int. Cl.
*F21V 17/06* (2006.01)

(52) U.S. Cl. ..... 362/438; 362/374; 362/375; 362/382; 362/455

(58) Field of Classification Search ..... 362/351, 362/374, 375, 455, 382, 438
See application file for complete search history.

(56) References Cited

U.S. PATENT DOCUMENTS 6,428,188 B1 * 8/2002 Magno et al. ..... 362/362

* cited by examiner

*Primary Examiner*—Stephen F Husar
*Assistant Examiner*—Meghan K. Dunwiddie
(74) *Attorney, Agent, or Firm*—Rosenberg, Klein & Lee

(57) ABSTRACT

A lampshade-fixing seat structure including a fixing seat for fixing a lampshade. The fixing seat is substantially bowl-shaped and has a circumferential wall with a predetermined height. The lampshade is formed with an annular groove having outer rims. The lampshade-fixing seat structure further includes more than two stopper leaf springs. Each of the stopper leaf springs has a fixed section fixed on inner face of the circumferential wall of the fixing seat. The stopper leaf spring further has a first stopper section inward obliquely extending from the fixing section and a second stopper section obliquely extending from one end of the first stopper section in reverse direction. The first and second stopper sections of the stopper leaf spring resiliently abut against the outer rims of the annular groove of the lampshade to locate the lampshade in the fixing seat.

3 Claims, 8 Drawing Sheets

LAMPSHADE-FIXING SEAT STRUCTURE

BACKGROUND OF THE INVENTION

The present invention is related to a lampshade-fixing seat structure in which stopper leaf springs are disposed between the fixing seat and the lampshade for resiliently abutting against the lampshade. The lampshade can be easily assembled with the fixing seat and disassembled therefrom.

A conventional ceiling lamp is directly installed under a ceiling or under a ceiling fan as shown in FIG. 8 to provide illumination function. A lampshade 82 is fixed in a fixing seat 81. The lampshade 82 can be made from hard materials such as plastic, acryl, glass, etc. A bulb holder 83 is mounted in the fixing seat 81, in which a bulb 84 is mounted.

FIG. 9 is a sectional view showing the assembly of the lampshade 82 and the fixing seat 81. The circumference of the fixing seat 81 is formed with multiple thread holes 811. A top end of the lampshade 82 is formed with an annular groove 821. Screws 85 are screwed through the thread holes 811 into the annular groove 821 to fix the lampshade 82.

The above fixing measure has some shortcomings. For example, in the case that the screws 85 are slightly loosened, although the lampshade 82 will be still stopped from dropping, the lampshade 82 will vibrate and emit noise when the ceiling fan operates. Furthermore, in the case that the lampshade 82 is made of high-class glass, when over-tightening the screws 85, the glass may crack. Moreover, it is laborious and time-consuming to form the thread holes 811 on the fixing seat 81 and assemble/disassemble the lampshade 82. In addition, the assembly of the lampshade 82 and the fixing seat 81 has a considerably large volume and necessitates more packaging material when packaged. All these increase the manufacturing cost of the product.

SUMMARY OF THE INVENTION

It is therefore a primary object of the present invention to provide a lampshade-fixing seat structure in which stopper leaf springs are disposed between the fixing seat and the lampshade for resiliently abutting against the lampshade and locate the lampshade in the fixing seat. This avoids crack of the lampshade due to over-tightening and avoids noise caused by vibration of the lampshade when the ceiling fan operates. Further, by means of the resilience of the stopper leaf spring, the lampshade can be easily assembled/disassembled. Moreover, the fixing seat with the stopper leaf spring is applicable to the existent lampshade formed with the annular groove.

According to the above object, the lampshade-fixing seat structure of the present invention includes a fixing seat for fixing a lampshade. The fixing seat is substantially bowl-shaped and has a circumferential wall with a predetermined height. The lampshade is formed with an annular groove having outer rims. The lampshade-fixing seat structure further includes more than two stopper leaf springs. Each of the stopper leaf springs has a fixed section fixed on inner face of the circumferential wall of the fixing seat. The stopper leaf spring further has a first stopper section inward obliquely extending from the fixing section and a second stopper section obliquely extending from one end of the first stopper section in reverse direction. The first and second stopper sections of the stopper leaf spring resiliently abut against the outer rims of the annular groove of the lampshade to locate the lampshade in the fixing seat.

The present invention can be best understood through the following description and accompanying drawings wherein:

DETAILED DESCRIPTION OF THE PREFERRED EMBODIMENTS

Figure 1:
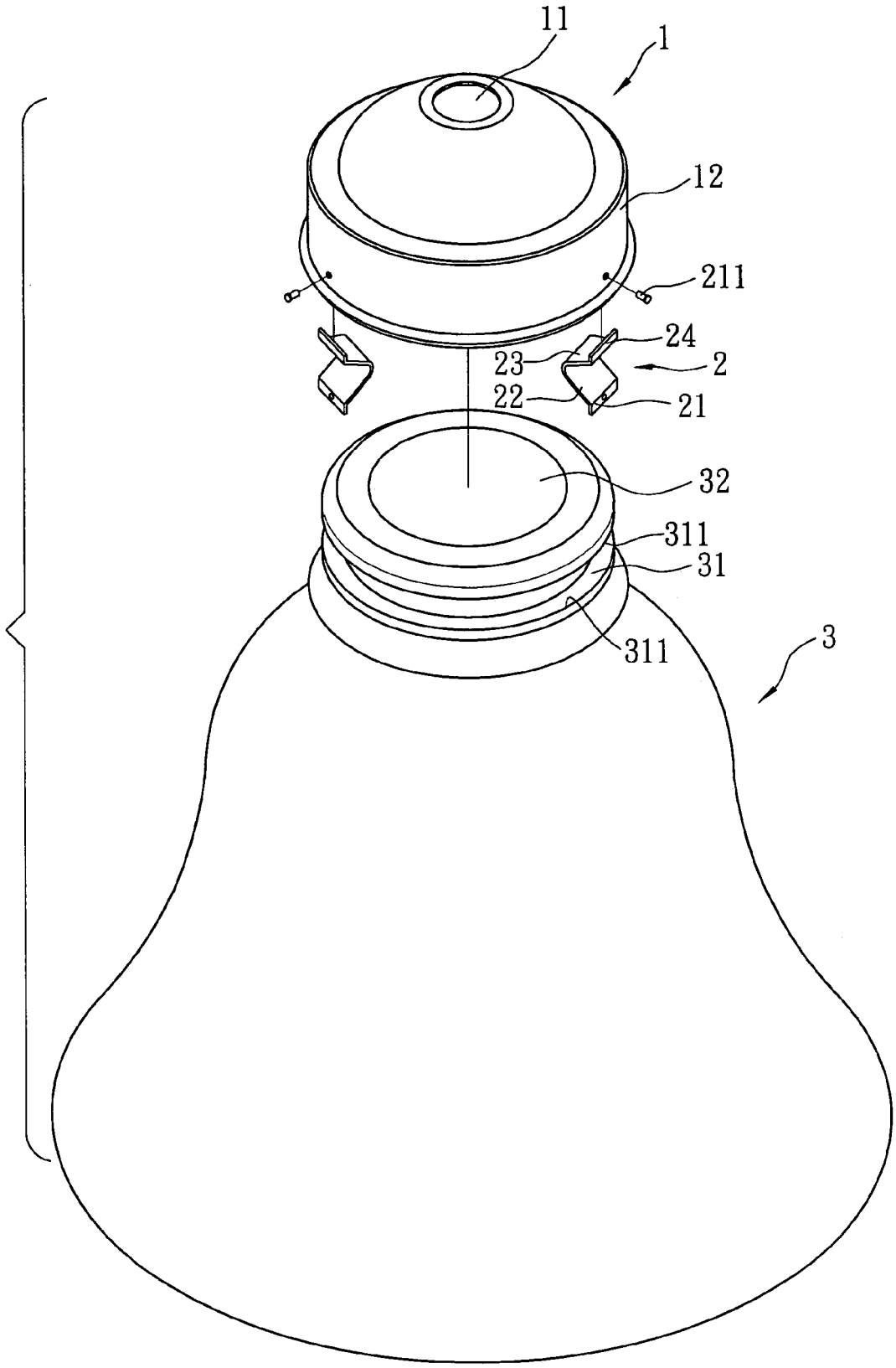
FIG. 1 is a perspective exploded view of a first embodiment of the lampshade-fixing seat structure of the present invention.
Figure 2:
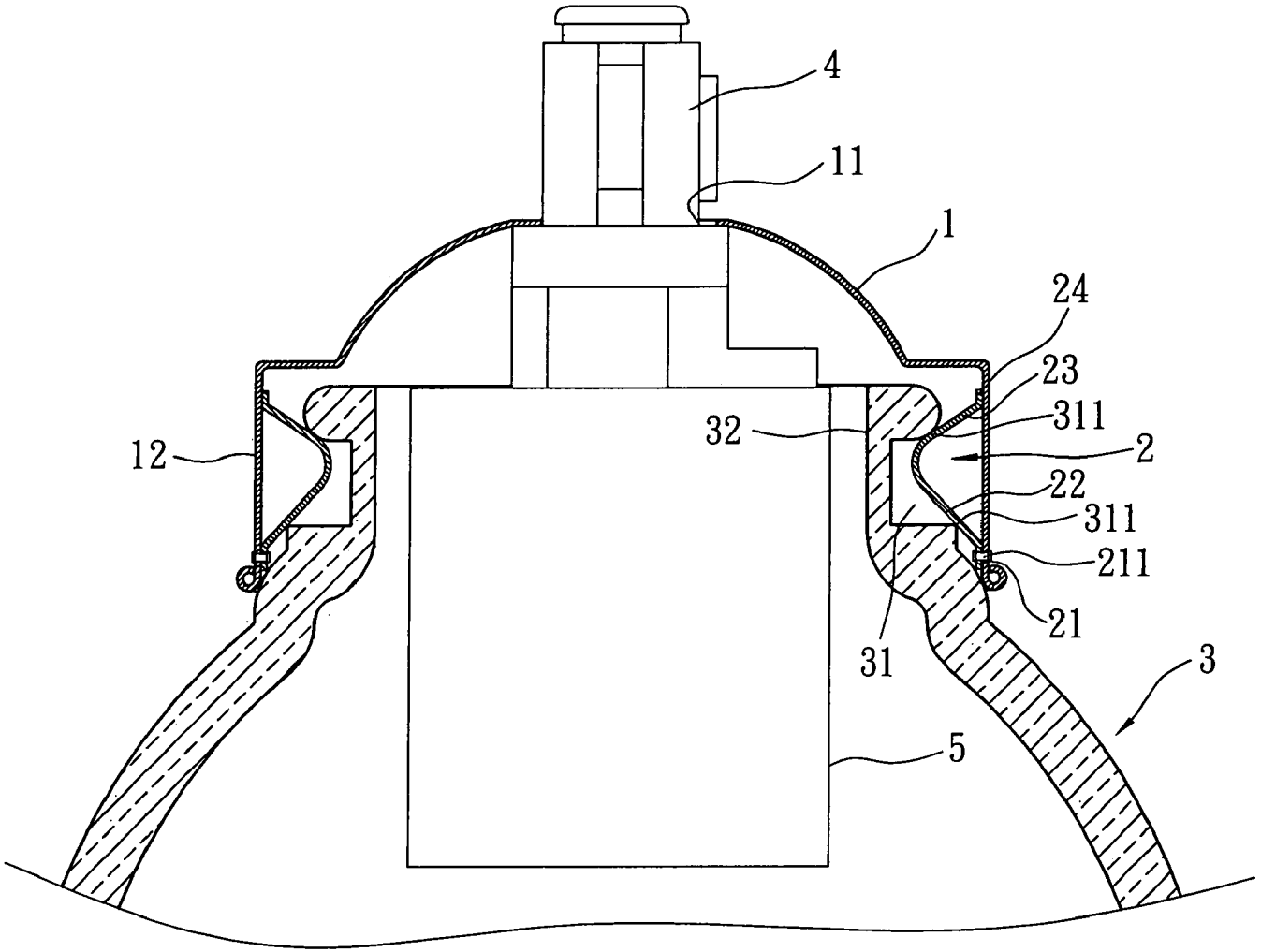
FIG. 2 is a sectional assembled view of the first embodiment of the lampshade-fixing seat structure of the present invention.
Figure 3:
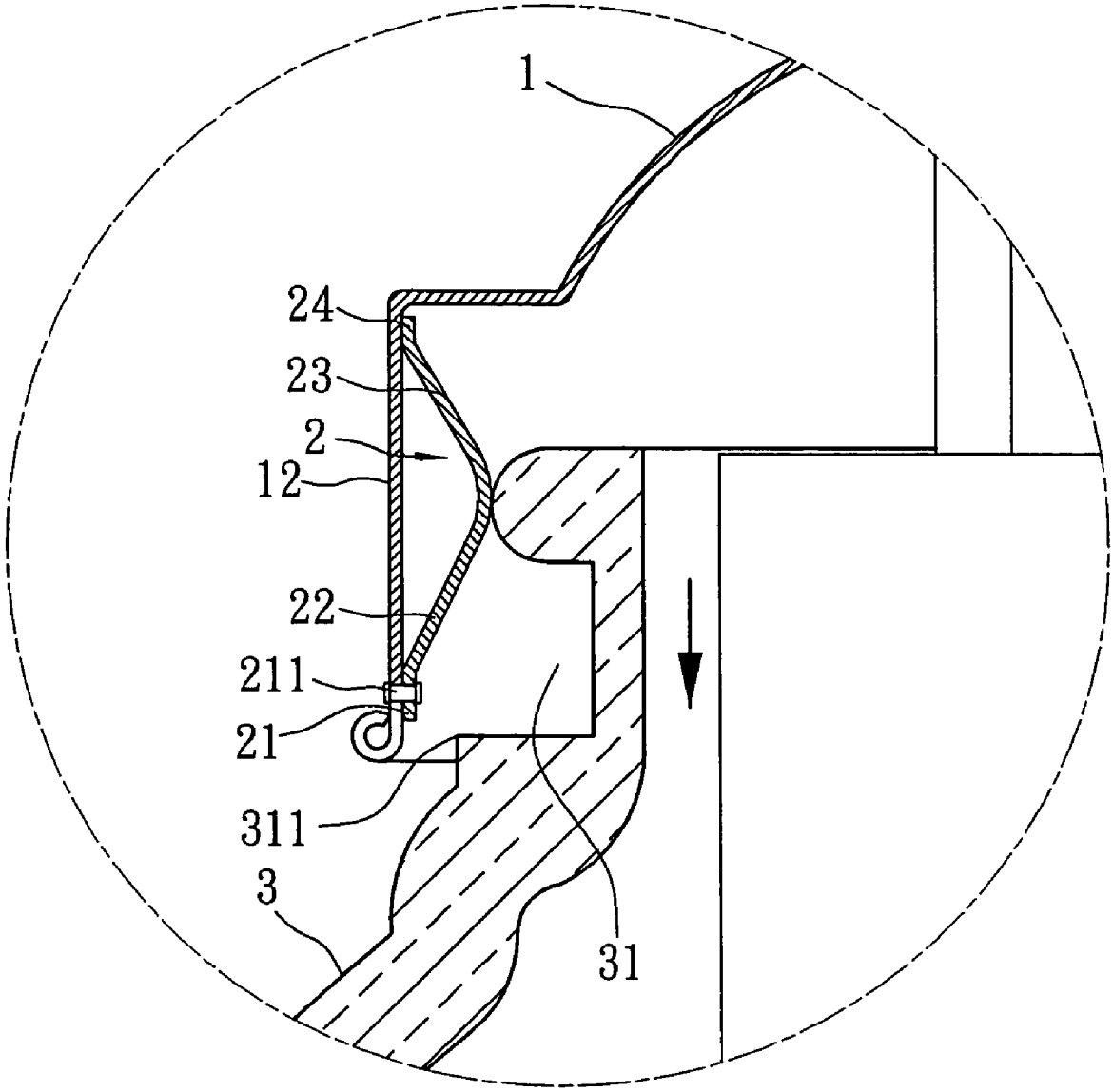
FIG. 3 is an enlarged sectional view of the first embodiment of the lampshade-fixing seat structure of the present invention, showing that the lampshade is extracted and the stopper leaf spring is disengaged from the annular groove of the lampshade.
Figure 4:
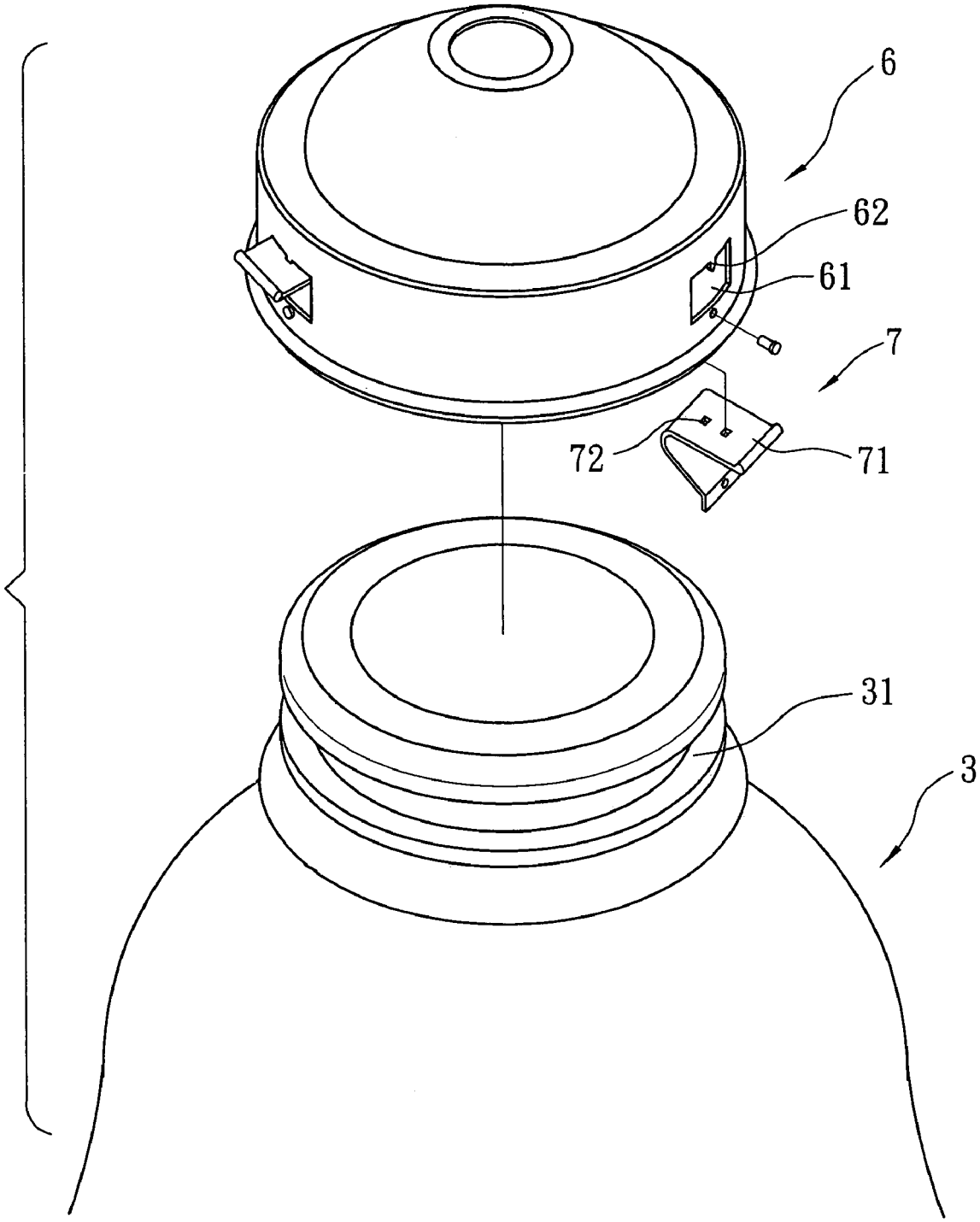
FIG. 4 is a perspective exploded view of a second embodiment of the lampshade-fixing seat structure of the present invention.
Figure 5:
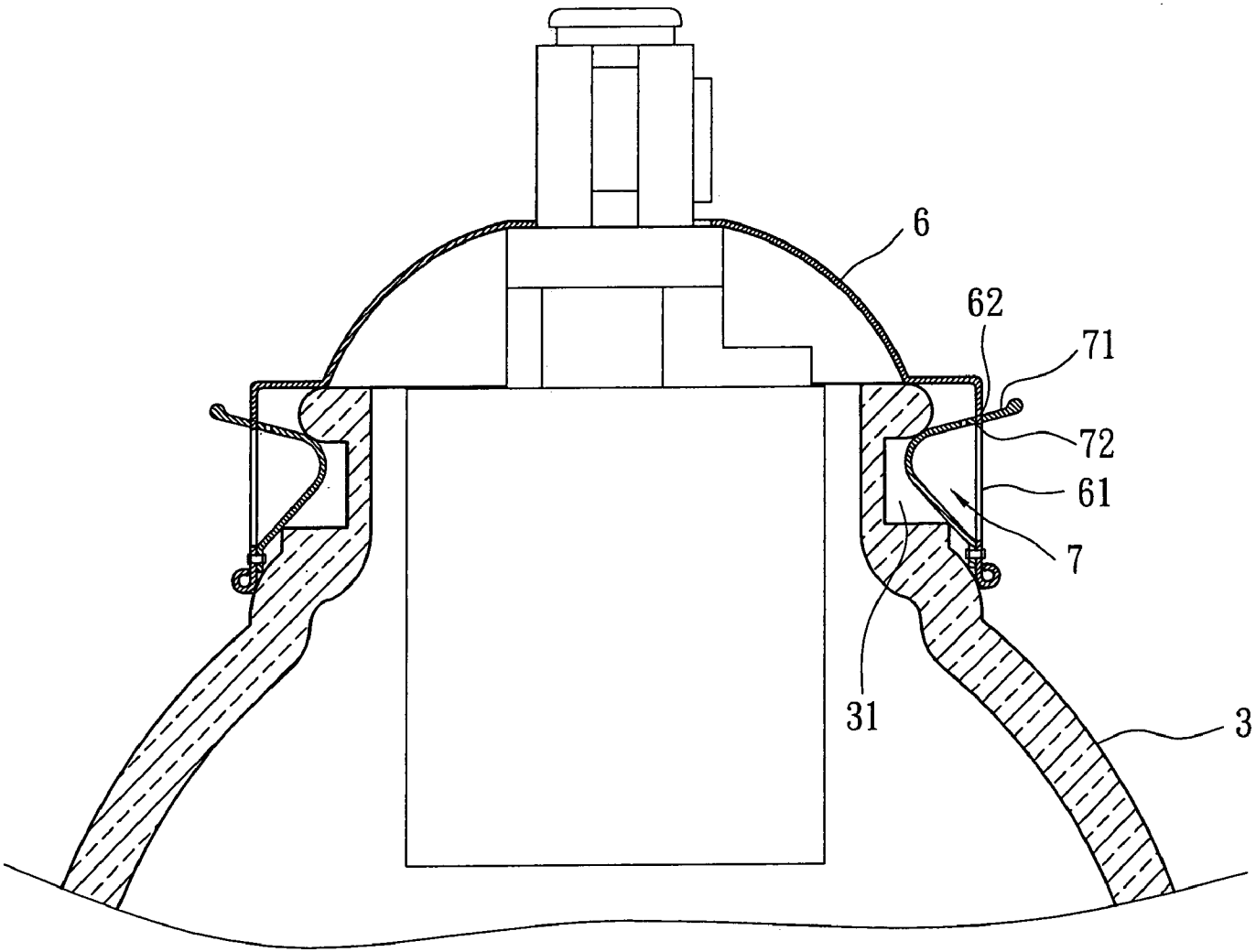
FIG. 5 is a sectional assembled view of the second embodiment of the lampshade-fixing seat structure of the present invention.

Please refer to FIGS. 1 to 3. The lampshade-fixing seat structure of the present invention includes a fixing seat 1 for fixing a lampshade 3. The fixing seat 1 is substantially bowl-shaped and has a circumferential wall 12 with a predetermined height. The lampshade 3 is formed with an annular groove 31 having outer rims 311.

The lampshade-fixing seat structure of the present invention further includes more than two stopper leaf springs 2 disposed on the fixing seat 1 at equal intervals. Each stopper leaf spring 2 has a fixed section 21 fixed on inner face of the circumferential wall 12 of the fixing seat 1. The stopper leaf spring 2 further has a first stopper section 22 inward obliquely extending from the fixing section 21 and a second stopper section 23 obliquely extending from one end of the first stopper section 22 in reverse direction. The first and second stopper sections 22, 23 of the stopper leaf spring 2 resiliently abut against the outer rims 311 of the annular groove 31 of the lampshade 3 to locate the lampshade 3 in the fixing seat 1. A movable section 24 axially upward extends from the second stopper section 23. In this embodiment, the movable section 24 attaches to inner face of the circumferential wall of the fixing seat 1.

The fixed section 21 of the stopper leaf spring 2 can be fixed on the inner face of the circumferential wall 12 of the fixing seat 1 by a rivet 211 or by means of welding. In this embodiment, the fixed section 21 of the stopper leaf spring 2 is fixed on the inner face of the circumferential wall 12 by the rivet 211.

The fixing seat 1 is formed with a central through hole 11 and the lampshade 3 is formed with a central through hole 32. A connecting rod 4 is passed through the central through holes 11, 32 to fixedly connect the fixing seat 1 under a ceiling fan or a ceiling. A bulb holder 5 is fixedly connected with bottom end of the connecting rod 4, in which a bulb (not shown) is installed. The lampshade 3, connecting rod 4 and the bulb holder 5 pertain to prior art and are not included in the scope of the present invention.

Referring to FIG. 3, when detaching the lampshade 3, a user only needs to pull the lampshade 3 in a direction to the open end of the lampshade 3. At this time, the second stopper section 23 of the stopper leaf spring 2 is pressed by the lampshade 3 and the movable section 24 is driven to slide away from the fixed section 21. Under such circumstance, the first and second stopper sections 22, 23 of the stopper leaf spring 2 are disengaged from the outer rims 311 of the annular groove 31 of the lampshade 3, permitting the user to take out the lampshade 3. The lampshade 3 can be assembled with the fixing seat 1 by reverse operation.

According to the above arrangement, when assembling the lampshade 3 with the fixing seat 1, the first and second stopper sections 22, 23 resiliently abut against the outer rims 311 of the annular groove 31 of the lampshade 3. This avoids crack of the lampshade 3 due to over-tightening and avoids noise caused by vibration of the lampshade 3 when the ceiling fan operates. Further, by means of the resilience of the stopper leaf spring 2, the lampshade 3 can be easily assembled/disassembled. Moreover, the fixing seat 1 with the stopper leaf spring 2 is applicable to the existent lampshade 3 formed with the annular groove 31.

FIGS. 4 to 7 show a second embodiment of the present invention, in which the circumference of the fixing seat 6 is formed with several windows 61. A locating projection 62 is formed on the periphery of each window 61. The second stopper section 71 of the stopper leaf spring 7 is formed with multiple locating holes 72. The locating projection 62 of the window 61 of the fixing seat 6 can be fitted in any of the locating holes 72.

Figure 6:
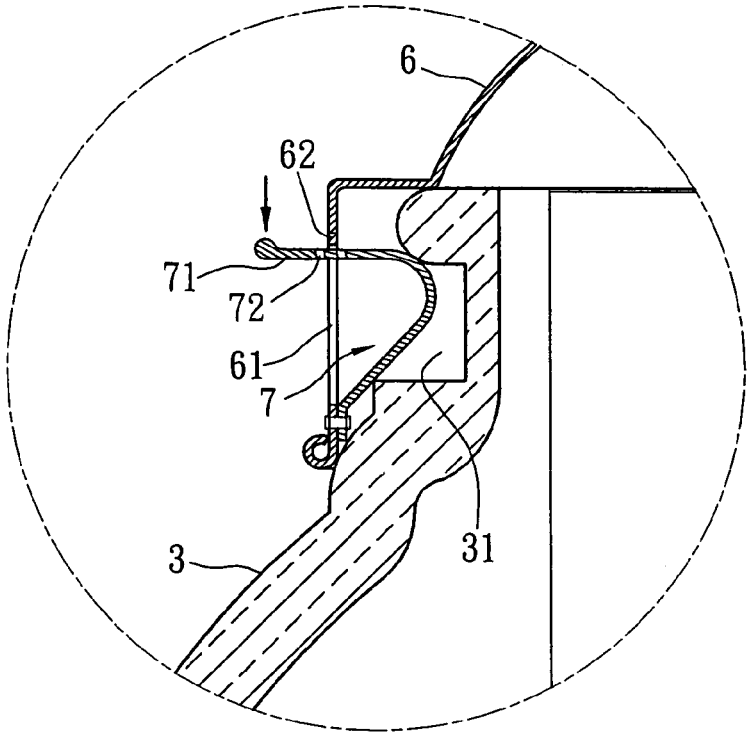
FIG. 6 is an enlarged sectional view of the second embodiment of the lampshade-fixing seat structure of the present invention, showing that the second stopper section of the stopper leaf spring is pressed to extract the locating projection out of the locating hole of the second stopper section.
Figure 7:
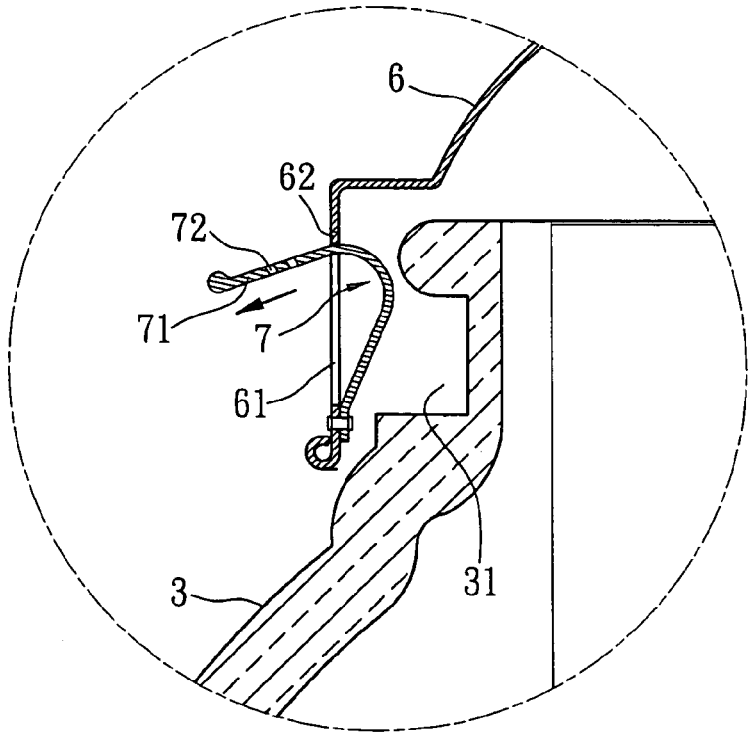
FIG. 7 is an enlarged sectional view according to FIG. 6, showing that the stopper leaf spring is pulled outward and downward to disengage the stopper sections from the annular groove of the lampshade.
Figure 8:
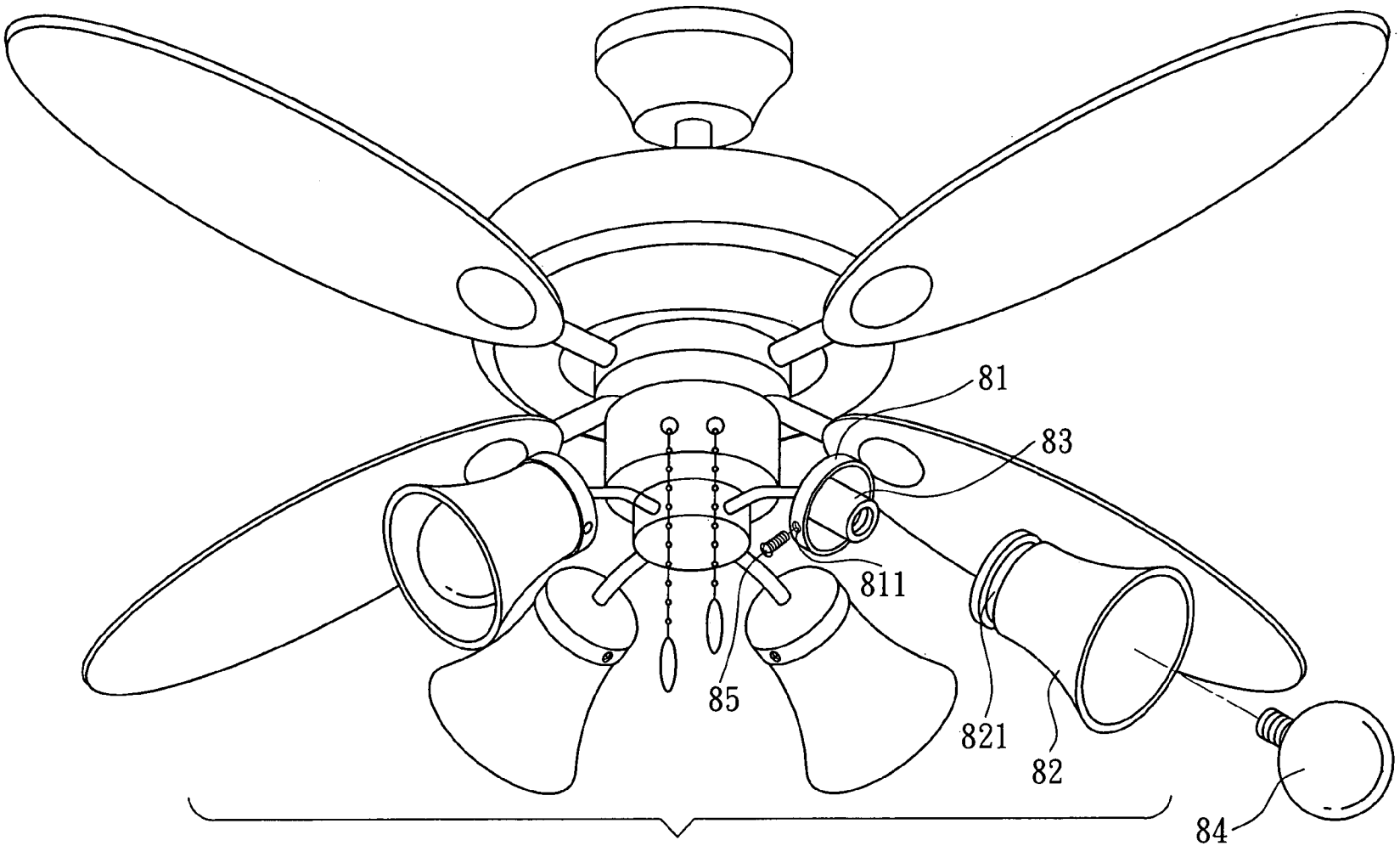
FIG. 8 PRIOR ART
FIG. 8 is a perspective partially exploded view of a conventional ceiling fan with ceiling lamps.
Figure 9:
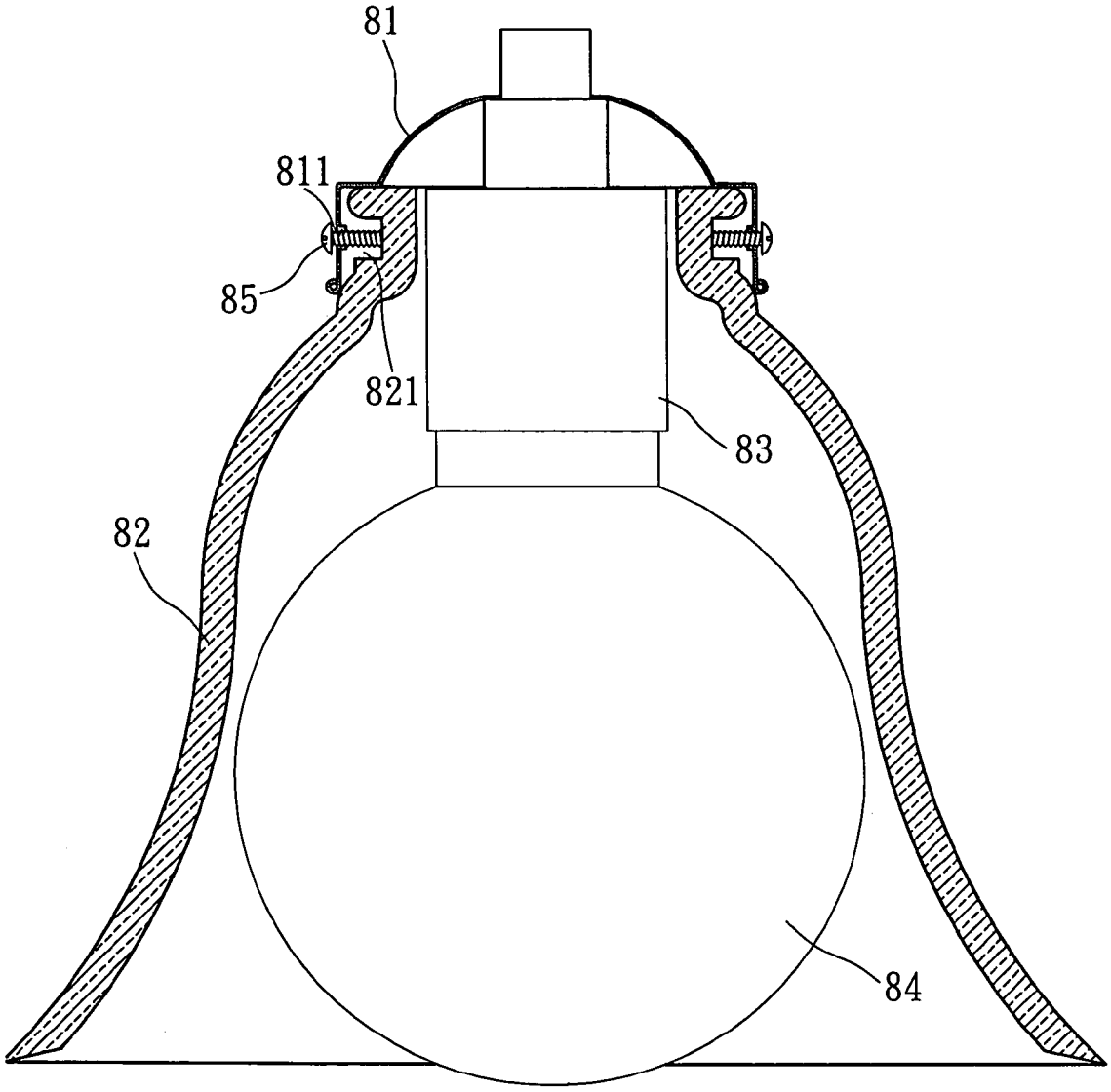
FIG. 9 PRIOR ART
FIG. 9 is a sectional assembled view of the conventional ceiling lamp.

Referring to FIGS. 6 and 7, when detaching the lampshade 3, a user first presses the second stopper section 71 of the stopper leaf spring 7 to extract the locating projection 62 out of the locating hole 72. Then the second stopper section 71 of the stopper leaf spring 7 is outward shifted to disengage the stopper leaf spring 7 from the annular groove 31 of the lampshade 3. At this time, the lampshade 3 can be taken off. The lampshade 3 can be assembled with the fixing seat 6 by reverse operation.

The above embodiments are only used to illustrate the present invention, not intended to limit the scope thereof. Many modifications of the above embodiments can be made without departing from the spirit of the present invention.

What is claimed is:

1. A lampshade-fixing seat structure comprising:

a fixing seat for fixing a lampshade, the fixing seat being substantially bowl-shaped and having a circumferential wall with a predetermined height, the lampshade being formed with an annular groove having a continuous annular outer rim; and more than two stopper leaf springs, each of the stopper leaf springs having a fixed section extending longitudinally and fixed on an inner face of the circumferential wall of the fixing seat, the stopper leaf spring further having a first stopper section extending obliquely inward from the fixing section and a second stopper section extending obliquely from one end of the first stopper section in a reverse direction, the first and second stopper sections of the stopper leaf spring extending into the annular groove and resiliently abutting against the annular outer rim of the annular groove of the lampshade to releasably retain the lampshade in the fixing seat.

2. The lampshade-fixing seat structure as claimed in claim 1, wherein the stopper leaf spring further has a movable section extending longitudinally from the second stopper section.

3. The lampshade-fixing seat structure as claimed in claim 1, wherein the circumferential wall of the fixing seat is formed with a plurality of windows, each window having a locating projection extending from a periphery thereof, the second stopper section of each stopper leaf spring being formed with multiple locating holes, each stopper leaf spring being affixed adjacent a respective one of the windows with the second stopper section extending therein, whereby the locating projection of each window of the fixing seat is selectively releasably engaged with one of the locating holes of a respective one of the stopper leaf springs to retain the first and second stopper sections in one of an engaged or disengaged position with the annular groove.

* * * * *